United States Patent [19]

Okabe

[11] 4,176,599

[45] Dec. 4, 1979

[54] DEVICE FOR INTERMITTENTLY DRIVING PRINTING RINGS IN A PRINTER

[75] Inventor: Katsuhiko Okabe, Tokorozawa, Japan

[73] Assignee: Copal Company Limited, Tokyo, Japan

[21] Appl. No.: 829,480

[22] Filed: Aug. 31, 1977

[30] Foreign Application Priority Data

Sep. 2, 1976 [JP] Japan ..... 51-118106[U]

[51] Int. Cl.[2] ..... B41J 1/22

[52] U.S. Cl. ..... 101/95; 110/111; 101/93; 101/22; 101/99

[58] Field of Search ..... 101/93.22, 93.44, 95, 101/96, 99, 110, 111

[56] References Cited

U.S. PATENT DOCUMENTS

| | | | |
|---|---|---|---|
| 3,654,860 | 4/1972 | Speicher et al. | 101/95 X |
| 3,731,622 | 5/1973 | Baoanoff | 101/93.22 |
| 3,738,264 | 6/1973 | Sobottka et al. | 101/110 |
| 3,771,442 | 11/1973 | Ditman | 101/95 X |
| 3,793,951 | 2/1974 | Denley | 101/111 |
| 3,838,638 | 10/1974 | Clary | 101/99 X |
| 3,865,030 | 2/1975 | Chida et al. | 101/93.22 |
| 3,889,593 | 6/1975 | McVey | 101/110 |
| 3,991,672 | 11/1976 | Keith et al. | 101/99 |

*Primary Examiner*—Edward M. Coven
*Attorney, Agent, or Firm*—J. Harold Nissen

[57] ABSTRACT

The printer has a plurality of printing rings each rotatably supported by a swingable layer pivoted about a pivot axis so as to be swung in an arcuate path around the pivot axis while it is rotated by a driving source about its own axis so that the printing rings are selectively swung toward and against a platen upon receipt of printing character selection command from the control circuit of the printer so as to print onto a paper held therebetween when the selected one of the characters on the respective printing ring is brought to a position for the printing during the rotation thereof. The driving source for the rotation of the printing rings is controlled by pulses so that the rotation about the axis of the respective printing ring is rendered to be intermittent and the swinging of the respective swingable lever for the printing operation is effected during the time the respective printing ring is held stationary in its intermittent rotation thereby insuring exact printing operation of the selected characters.

11 Claims, 14 Drawing Figures

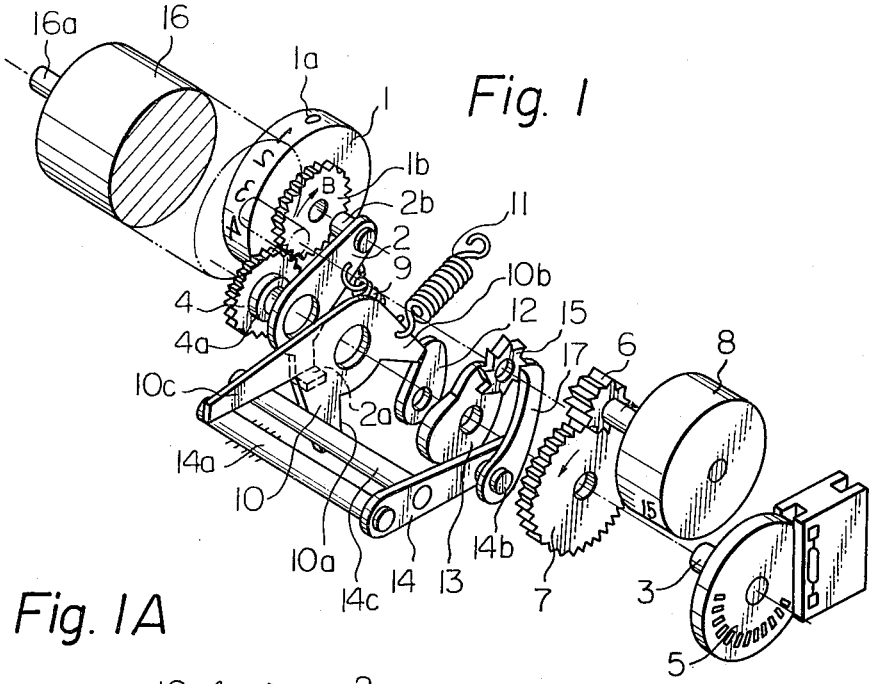
Fig. 1
Fig. 1A
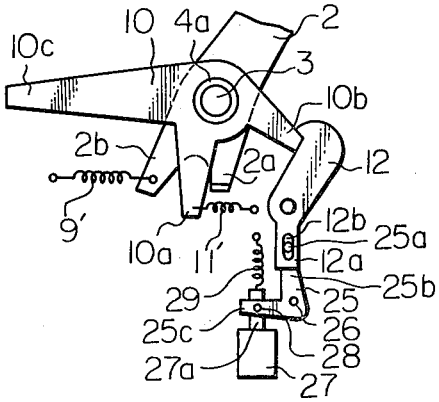
Fig. 2
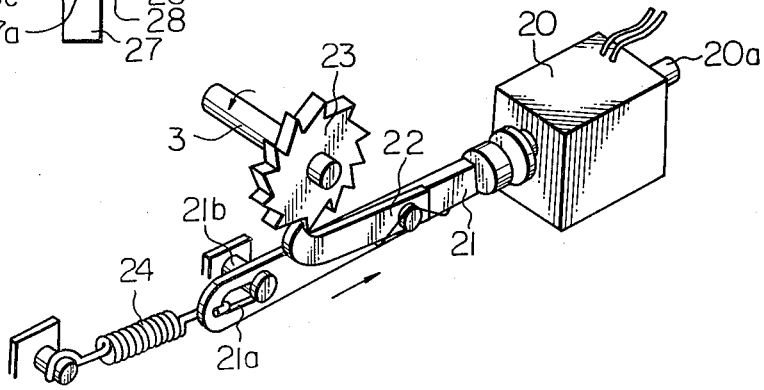

DEVICE FOR INTERMITTENTLY DRIVING PRINTING RINGS IN A PRINTER

BACKGROUND OF THE INVENTION

The present invention relates to improvements in a device for driving printing rings in a printer having the printing rings each rotatably supported by a swingable lever adapted to be swung about its pivot axis so as to move the respective printing ring in an arcuate path around the pivot axis toward and against a platen for printing onto a paper therebetween a selected character of the respective printing ring selected for the printing operation during the rotation thereof.

A printer of the type described above has a plurality of printing rings each provided on the periphery thereof a plurality of printing characters and each rotated about its own axis by a driving source, the respective printing ring being supported by a swingable lever pivoted about a pivot axis so that the respective printing ring is selectively moved in an arcuate path from a normally held inoperative position toward and against a platen around the pivot axis by a printing character selection command from a control circuit of the printer so as to print onto a paper held therebetween a selected printing character on the printing ring selected during the rotation of the printing ring. An electric motor is usually used in rotating the respective printing rings while a spring is used in swinging the respective swingable lever supporting the rotating printing ring wherein the printing ring is rollingly moved toward and away from the platen during the swinging movement of the lever by the engagement of a gear rotated about the pivot axis of the lever with a gear integral and coaxial with the printing ring for rotating the printing ring about its axis.

In the prior art printer of the type described above, since an electric motor is used as the driving source for rotating the respective printing rings, the respective printing rings are rotated at all times during the operation of the printer. Therefore, in swinging the swingable lever selectively upon receipt of a printing character selection command from the control circuit for the printing operation, the peripheral speed of rotation of the respective printing ring about its axis is made equal but in opposite direction to the peripheral speed of the printing ring caused by the rolling movement thereof along the arcuate path around the pivot axis of the swingable lever so that the resultant peripheral speed of the respective printing ring is rendered to be zero when the printing ring abuts against the platen for the printing thereby aiming at insuring the exact printing of the selected character. However, since complicated construction is required in achieving the above described operation in the prior art printer, false positioning of the selected character with respect to the paper or false selection of the character could not be avoided in the prior art printer.

The present invention aims at avoiding the disadvantages of the prior art printer as described above.

SUMMARY OF THE INVENTION

An object of the present invention is to provide a novel and useful device for driving the printing rings in a printer of the type described above which positively avoids the above described disadvantages of the prior art printer.

The driving device of the present invention is characterized by the fact that the driving device drives the printing members such as the printing rings intermittently so that the movement of the respective printing ring in the arcuate path around the pivot axis of the swingable lever supporting the printing ring for the printing operation is effected during the time the rotation of the printing ring is intermittently stopped after selection of the printing character thereby insuring the exact positioning of the selected character for the proper printing operation.

In accordance with the present invention, a plurality of printing character supporting belts may be used in place of the printing rings, each of which belts is stretched around a sprocket coaxial with the pivot axis of the swingable lever and driven by the driving device and a sprocket rotatably supported on the free end of the swingable lever.

BRIEF DESCRIPTION OF THE DRAWINGS

FIG. 1 is a perspective view partly shown in exploded manner showing the main part of a first embodiment of a printer incorporating therein the driving device of the present invention;

FIG. 1A is a fragmentary side view showing the construction of the select lever mounted in the printer of FIG. 1;

FIG. 2 is a fragmentary perspective view showing a modification of the driving device of the present invention;

DETAILED DESCRIPTION OF THE PREFERRED EMBODIMENTS

Figure 3:
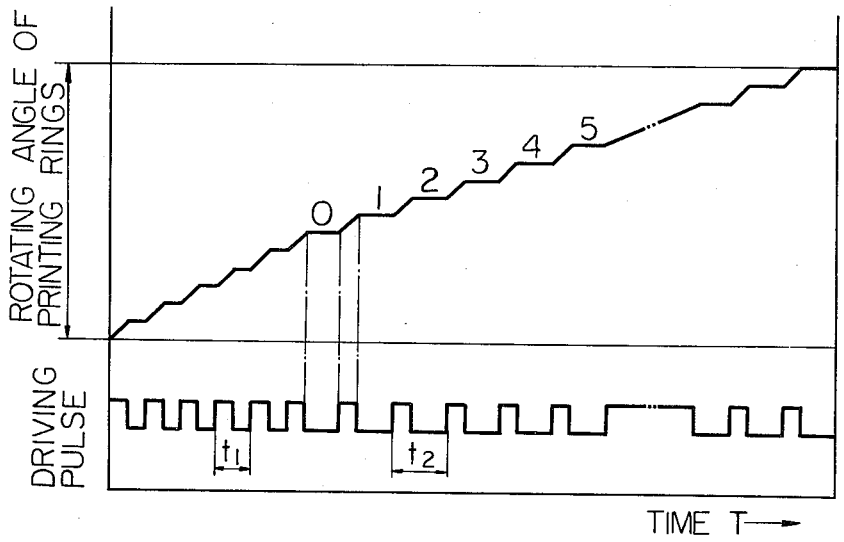
FIG. 3 is a diagram showing relationship between the rotating angle of the printing rings and the driving pulses for the driving device of FIG. 1 with respect to the lapse of time.

Referring first to FIG. 1, the printer incorporating therein the present invention comprises a plurality of printing rings 1 each having a plurality of printing characters 1*a* on the periphery thereof and a gear 1*b* integrally formed or secured on the side surface of the ring 1 coaxially therewith. Each printing ring 1 is rotatably supported on a shaft 2*b* secured to the free end of a swingable supporting lever 2 with an opening formed in the proximal end thereof rotatably fitted on a cylindrical hub 4a integrally formed on a driving gear 4 which engages with the gear 1b of the printing ring 1 and driven by a common driving shaft 3 driven by a pulse motor 8 through a gear 6 secured to the motor shaft and a gear 7 secured to the driving shaft. Thus, each printing ring 1 is rotated about the shaft 2b in the direction B.

Each swingable supporting lever 2 is urged in the clockwise direction by a spring 9 tensioned between the lever 2 and the machine frame of the printer so that the printing ring 1 is urged away from a platen 16 cooperating with the printing rings 1 as described later.

Each swingable lever 2 is formed with a downwardly extending portion having a bent lug 2a at the lower end thereof. A T-shaped driving lever 10 is provided for each swingable lever 2 and it is rotatably supported on the cylindrical hub 4a of the gear 4 with an opening formed in the driving lever 10 fitting thereon. Each driving lever 10 has a downwardly extending leg 10a and a pair of generally horizontally and oppositely extending arms 10b, 10c and is urged in the counterclockwise direction by a spring 11 tensioned between the lever 10 and the machine frame of the printer. The bent lug 2a of the swingable lever 2 is adapted to engage with the downwardly extending leg 10a of the driving lever 10 by the action of the springs 9 and 11. The spring 11 is made to have a greater spring force than the spring 9, so that the swingable lever 2 tends to be swung in the anticlockwise direction against the action of the spring 9 together with the driving lever 10 urged in the counterclockwise direction by the spring 11 having the greater spring force so as to move the printing ring 1 in the arcuate path around the driving shaft 3 toward against the platen 16 for printing onto a paper (not shown) held between the printing ring 1 and the platen 16 one of the characters 1a on the periphery of the printing ring 1. However, each driving lever 10 is normally arrested by a select lever 12 in a position so as to maintain the printing ring 1 apart from the platen 16 by the engagement of the arm 10b with the claw of the select lever 12 until the same is selectively released upon receipt of a printing command from the control circuit of the printer for the printing operation. To this end, each select lever 12 is operably coupled with a bell crank lever 25, for example, pivoted by a shaft 26 with a pin 25a on one arm 25b thereof slidably engaging with an elongated hole 12b formed in the downwardly extending leg while the other arm 25c is connected by a pin 28 to the armature 27a of an electro-magnet 27 controlled by the printing command from the control circuit as shown in FIG. 1A which shows somewhat modified form of the arrangement of the levers 2 and 10 but the actuation thereof is substantially similar to that of FIG. 1. Thus, upon issuance of the printing signal, the electromagnet 27 is energized to actuate the bell crank lever 25 so as to release the select lever 12 from the driving lever 10 for effecting the printing operation.

In order to limit the swinging movement of each driving lever 10 in the counterclockwise direction by the action of the spring 11 for urging the printing ring 1, a shaft 14a is stationarily provided in the machine frame of the printer which extends beneath the arm 10c of the driving lever 10 so that, when the latter is swung in the counterclockwise direction by the action of the spring 11 urging the swingable lever 2 in the same direction against the action of the spring 9, the lever 10 is stopped by the abutment of the arm 10c against the shaft 14a just before the printing ring 1 abuts against the platen 16. This allows the swingable lever 2 and the printing ring 1 to continue to move in the counterclockwise direction by their inertia to cause abutment of the printing ring 1 against the platen 16 for the printing operation after the driving lever 10 has been arrested by the shaft 14a thereby permitting the printing ring 1 to be instantaneously moved apart from the platen 16 after the abutment of the printing ring 1 against the platen 16 by the aid of the action of the spring 9 and held at a position wherein the swingable lever 2 is arrested by the driving lever 10 which has been arrested by the shaft 14a. This insures the accurate printing operation without deteriorating the quality of the printed characters on the paper.

In order to restore the driving lever 10 to its initial position arrested by the select lever 12 which has been returned to its initial arresting position for the driving lever 10 by the deenergization of the electromagnet 27, a shaft 14c is provided beneath the arm 10c of the driving lever 10, which is secured to a resetting lever 14 pivoted about the shaft 14a and urged in the counterclockwise direction by a spring (not shown) so that, when the resetting lever 14 is swung in the counterclockwise direction, the shaft 14c is moved upwardly to urge the arm 10c so that the driving lever 10 is swung in the clockwise direction together with the swingable lever 2 (which is moved by the action of the spring 9) to engage the arm 10b with the select lever 12 thereby arresting the lever 10 in its initial position while the swingable lever 2 and the printing ring 1 are restored to their initial positions.

In order to swing the resetting lever 14 in timed relationship to the operation of the select lever 12, a resetting cam 13 is secured to the driving shaft 3 which cooperates with a shaft 14b secured to the free end of the resetting lever 14. The cam 13 has a recessed cam portion on the periphery thereof at an appropriate angular position thereof so that, when the recessed cam portion of the cam 13 engages with the shaft 14b during the rotation of the cam 13, the lever 14 is swung in the counterclockwise direction to move the shaft 14c upwardly so that the driving lever 10 is reset so as to be arrested by the select lever 12.

In order to feed the paper held on the periphery of the platen 16 in cooperation with paper guide means (not shown) after completion of each printing operation, the platen 16 is secured to a rotatable shaft 16a so that the platen 16 is rotated when the shaft 16a rotates. A ratchet wheel 15 is secured to the shaft 16a and it cooperates with a claw lever 17 which is swingably supported with its lower end by the shaft 14b of the resetting lever 14 and urged toward the ratchet wheel 15 by a spring not shown so as to engage the claw of the claw lever 17 with the ratchet wheel 15.

Thus, as the resetting lever 14 is reciprocally swung to reset the driving lever 10, the claw lever 17 rotates the ratchet wheel 15 in timed relationship to the resetting of the driving lever 10 thereby rotating the platen 16 to feed the paper thereon a predetermined amount after completion of the printing operation.

A detecting disc 5 is secured to the driving shaft 3, which has a plurality of detecting means such as magnetic pieces or openings along a circular line coaxial with the shaft 3 at positions corresponding to the arrangement of the characters 1a on each printing ring 1. The detecting means cooperate with a sensing means such as a reed switch cooperating with the respective magnetic piece or a photoelectric signal generating element receiving light through the respective opening so as to issue electric signals as the disc 5 rotates, which are applied to the control circuit of the printer.

The arrangement of the printing characters on the respective printing ring and the detecting means in the detecting disc 5 with respect to the driving pulses for the pulse motor 8 are so determined that the respective printing ring 1 is rotated by one pitch between the adjacent two characters 1*a* so that the succeeding one of the characters 1*a* is brought to the predetermined printing position with respect to the platen 16 for the printing operation while the detecting disc 5 is rotated so that a signal is issued simultaneously with the positioning of the respective character at the printing position each time a pulse is applied to the pulse motor 8 so as to drive the same stepwise. Thus, the signals issued by the detecting disc 5 can be used as the character pulses for selecting desired character 1*a* from the characters 1*a* on the printing ring 1.

The operation of the printer as described above is as follows.

Upon receipt of the printing command from the control circuit of the printer issuing driving pulses for the motor 8, the pulse motor 8 is intermittently rotated so that the driving shaft 3 is rotated through gears 6,7 thereby rotating the respective printing ring 1 through gears 4*a*, 1*b* in the direction B so as to position the character 1*a* on the respective printing ring 1 successively one by one at the printing position. The rotation of the printing ring 1 is detected by the detecting disc 5 so that the character pulses are applied to the control circuit, When the printing signal from the counter in the control circuit coincides with the character pulses, the character selection command is generated to selectively energize the respective electromagnet 27 so that the select lever 12 is actuated to release the driving lever 10 to move the printing ring 1 against the platen 16 for printing the selected character 1*a* onto the paper. After completion of the printing operation, the resetting lever 14 is actuated by the cam 13 so as to reset the driving lever 10, while the paper is fed by the platen 16 rotated by the ratchet wheel 15 in cooperation with the claw lever 17.

FIG. 2 shows a modification of the embodiment of FIG. 1. The embodiment shown in FIG. 2 comprises a plunger solenoid 20 having an armature 20*a* to the tip of which an arm 21 is secured. The arm 21 has at its forward end an elongated hole 21*a* in which a guide pin 21*b* secured to the machine frame is slidably received so as to guide the reciprocal movement of the arm 21. The arm 21 is urged toward the left in FIG. 2 by a spring 24 tensioned between the arm 21 and the machine frame. A driving claw lever 22 is pivotally supported on the arm 21 by a pin secured to the arm 21 and urged in the clockwise direction by a spring. The claw of the claw lever 22 cooperates with a ratchet wheel 23 fixedly secured to the driving shaft 3.

In operation, when a printing command in the pulse form is applied to the plunger solenoid 20, the armature 20*a* is attracted to move the arm 21 toward the right against the action of the spring 24 so as to rotate the ratchet wheel 23 by the claw lever 23 and, after the solenoid 20 is deenergized the arm 21 is moved back to the left by the action of the spring 24. since the pulses are applied to the plunger-solenoid 20, the driving shaft 3 is rotated intermittently each time the plunger solenoid 20 is energized so as to locate one by one the succeeding printing character 1*a* of each printing ring 1 in the printing position.

In the embodiments shown in FIGS. 1 and 2, stopper means may be provided for preventing the ratchet wheel 15 from being rotated in the reverse direction so as to insure positive stepwise rotation of the same by the action of the claw lever 17.

In the like manner, stopper means may be provided so as to prevent the ratchet wheel 23 from rotating in the reverse direction.

FIG. 3 shows the time chart illustrating the manner in which the printing rings are rotated by the driving pulses.

Since the printing rings 1 are moved toward the platen for the printing operation during the time the rotation of the respective printing ring is held stationary in its intermittent rotation about its axis, the accurate positioning of the printing character is insured to improve the quality of the printing.

Figure 4:
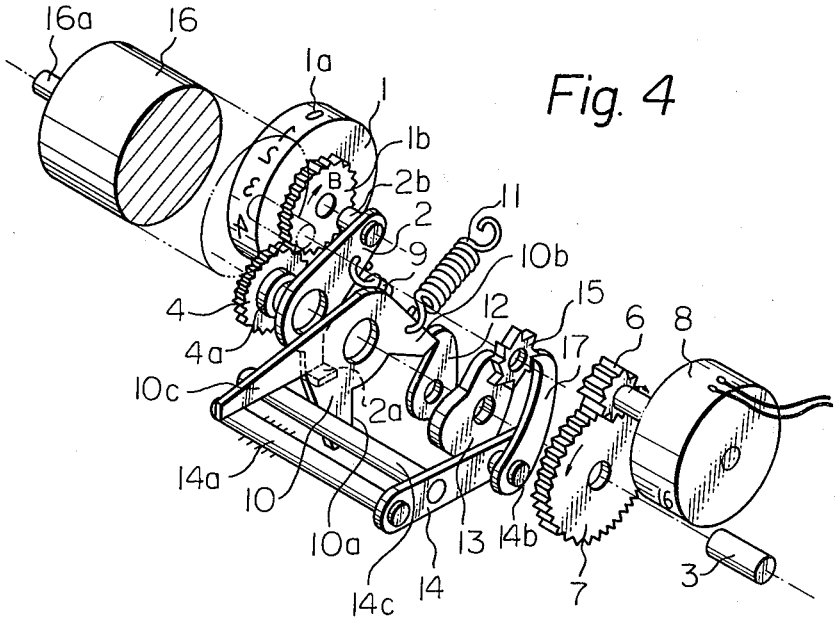
FIG. 4 is a perspective view similar to FIG. 1 but showing a second embodiment of the present invention.

FIG. 4 shows a second embodiment of the present invention. This embodiment is substantially similar to that shown in FIG. 1 except that the detecting disc for generating the character pulses in synchronism with the positioning of the character at the position for the printing operation is dispensed with, and the driving pulses per se generated by the issuance of the printing command are used as the character pulses.

In order to utilize the driving pulses as the character pulses, the driving pulses are counted so as to determine which individual one of the successive pulses corresponds to the first character in the series of the characters. Then, the succeeding characters are designated by the successive pulses, respectively. In detecting a complete rotation of the printing rings, a reed switch may be used in cooperation with a magnetic piece adapted to be rotated one revolution each time the printing ring rotates one revolution, so that a signal is generated each time the printing ring rotates one revolution. Alternatively, a single pulse is generated when the printing ring rotates to a predetermined angular position, from which time the counting of the driving pulses is commenced.

Figure 5:
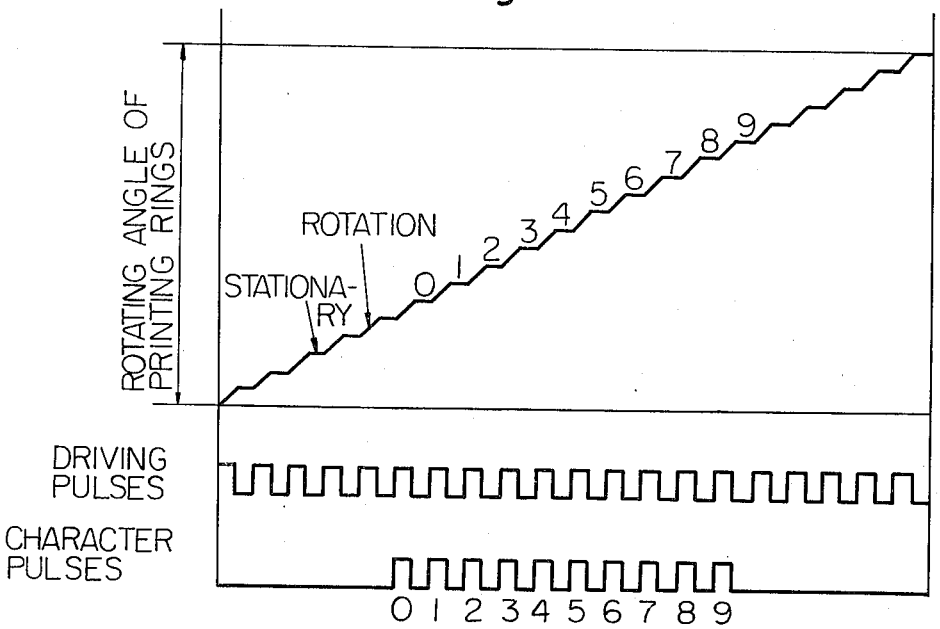
FIG. 5 is a diagram similar to FIG. 3 but showing the one for the embodiment of FIG. 4.

FIG. 5 shows the time chart illustrating the manner in which the embodiment of FIG. 4 operates.

Figure 6:
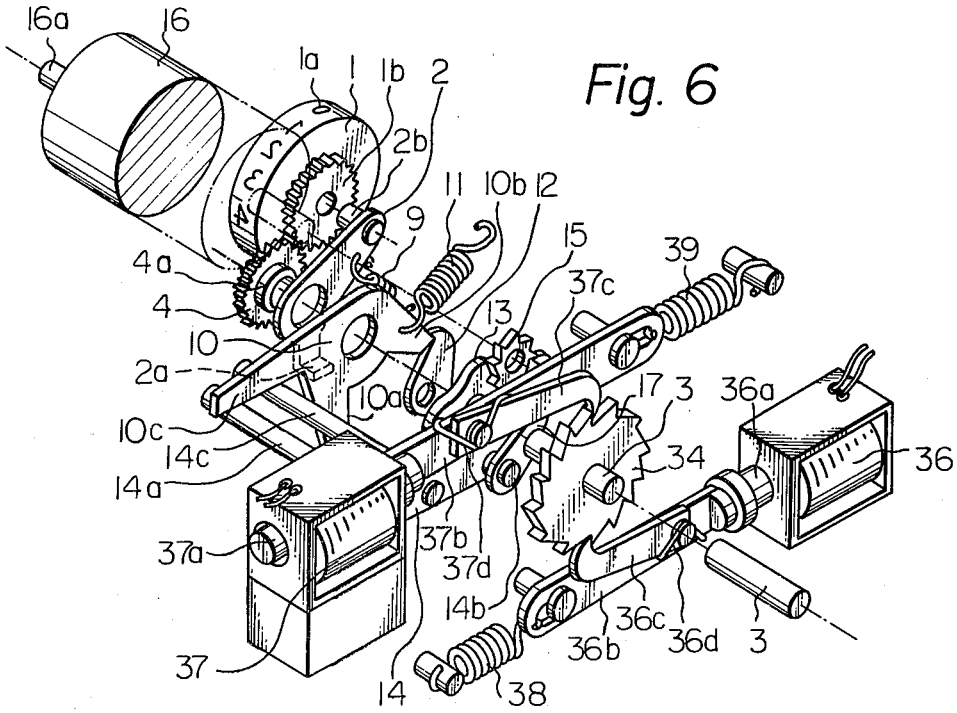
FIG. 6 is a perspective view similar to FIG. 1 but showing a third embodiment of the present invention.

FIG. 6 shows a third embodiment of the present invention.

This embodiment is substantially similar to that shown in FIG. 1 except that the pulse motor 8 in FIG. 1 is replaced by a pair of plunger-solenoids 36, 37 each similar in construction to that shown in FIG. 2 so as to make it possible to rotate the driving shaft 3 at a higher speed when each printing ring 1 is rotating in the range where no selection of the character 1*a* is needed so as to raise the printing efficiency of the printer.

To this end, the solenoids 36 and 37 are arranged in axial symmetry with respect to the driving shaft 3 so that the claw levers 36*c* and 37*c* engage with the ratchet wheel 34 secured to the driving shaft 3 at diametrically opposite points thereof.

In operation, the driving pulses A (FIG. 7) are first generated to energize the solenoid 36 so as to rotate the ratchet wheel 34 together with the driving shaft 3 in a like manner as in the case of FIG. 2 so as to rotate each printing ring 1 by one pitch between the adjacent two characters 1*a* of the printing ring 1. Just before the return movement of the arm 36*b* of the solenoid 36 by the action of the spring 38 after deenergization of the solenoid 36 is completed, the driving pulses B (FIG. 7) are generated to further rotate the ratchet wheel 34 so as to rotate each printing ring 1 by one pitch between the adjacent two characters 1*a*, and, thereafter, the arm 37*b* of the solenoid 37 is returned to its initial position after deenergization of the solenoid 37 by the action of the spring 39. The above sequence of operations is repeated so as to intermittently rotate each printing ring 1.

In this embodiment, the pulses A, B are utilized as the character pulses. Thus, the pulses A, B are counted to detect the positioning of the corresponding character 1*a* of each printing ring 1.

When the printing selection command is applied as the selected character 1*a* of the respective printing ring 1 is brought to the position for the printing operation, the select lever 12 is selectively released to effect the printing in the manner described previously and, thereafter, each printing ring 1 is restored to its initial position simultaneously by the action of the resetting lever 14.

Figure 7:
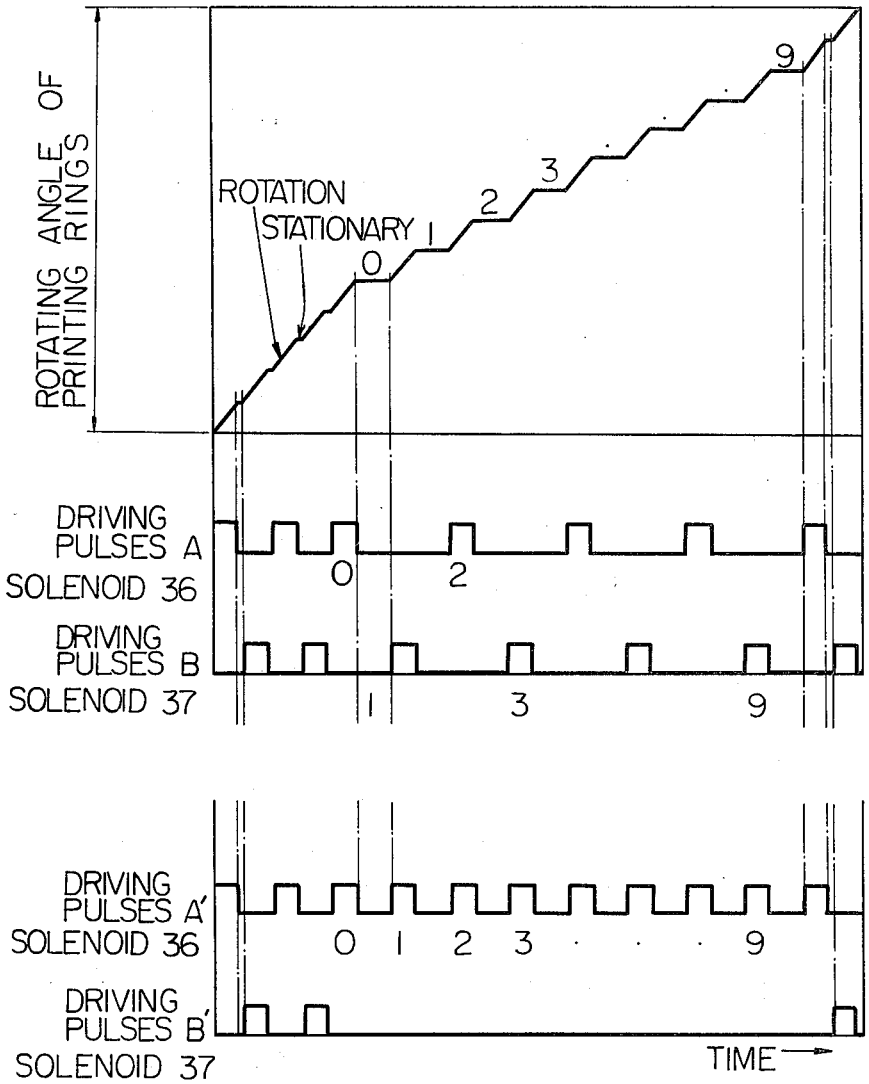
FIG. 7 is a diagram similar to FIG. 3 but showing the one for the embodiment of FIG. 6.

With reference to FIG. 7 showing the time chart of the operation of the embodiment of FIG. 6, it is seen that each printing ring 1 is rotated at a higher speed by the driving pulses A and, B each having a higher frequency during the time each printing ring 1 is rotating in the range where no selection of the character 1*a* is needed so as to raise the efficiency of the printer, while each printing ring 1 is rotated at a slower speed when the selection of the character 1*a* is needed by virtue of the driving pulses A, B each of which is rendered to have a lower frequency, so that accurate operation of the selection of the character 1*a* and the accurate printing operation are insured.

Alternative forms of the driving pulses are shown in FIG. 7 as the pulses A′ and B′ in order to carry out the similar operation of each printing ring 1. In this case, the driving pulses A′ are generated at the regular interval for selective actuation of the printing ring 1 for the printing operation while the driving pulses B′ are generated only when it is desired to rotate the printing ring 1 at a higher speed in the range where no selection of the character 1*a* is needed.

Figure 8:
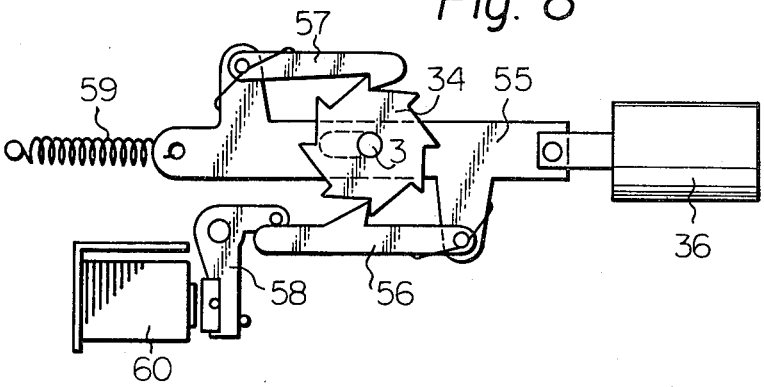
FIG. 8 is a fragmentary side view showing a modification of FIG. 6.

FIG. 8 shows a modification of the embodiment of FIG. 6.

In this embodiment, the solenoid 37 and the components belonging thereto are dispensed with, but the arm 55 of the solenoid 36 is guided by the driving shaft 3 slidably fitting in an elongated hole formed in the arm 55 and is provided with a pair of claw levers 56, 57 engaging with the ratchet wheel 34 at diametrically opposite points thereof as shown in the figure. A solenoid 60 is provided which actuates a bell crank lever 58. The lever 58 cooperates with the claw lever 56 so as to disengage the claw lever 56 when the solenoid 60 is energized.

In operation, when the printing ring 1 is to be rotated at a higher speed, the solenoid 60 is held deenergized so that the ratchet wheel 34 is driven by both the claw levers 56, 57 each time the arm 55 is moved toward the right by the energization of the solenoid 36 and restored to its initial position by the action of the spring 59 after deenergization of the solenoid 36.

When it is desired to drive the ratchet wheel 34 at a lower speed for the selection of the character 1*a* and the printing operation, the solenoid 60 is held energized so that the claw lever 56 is disengaged from the ratchet wheel 34 and the latter is driven solely by the claw lever 57 each time the arm 55 is moved to the left by the action of the spring 59 after deenergization of the solenoid 36.

Figure 9:
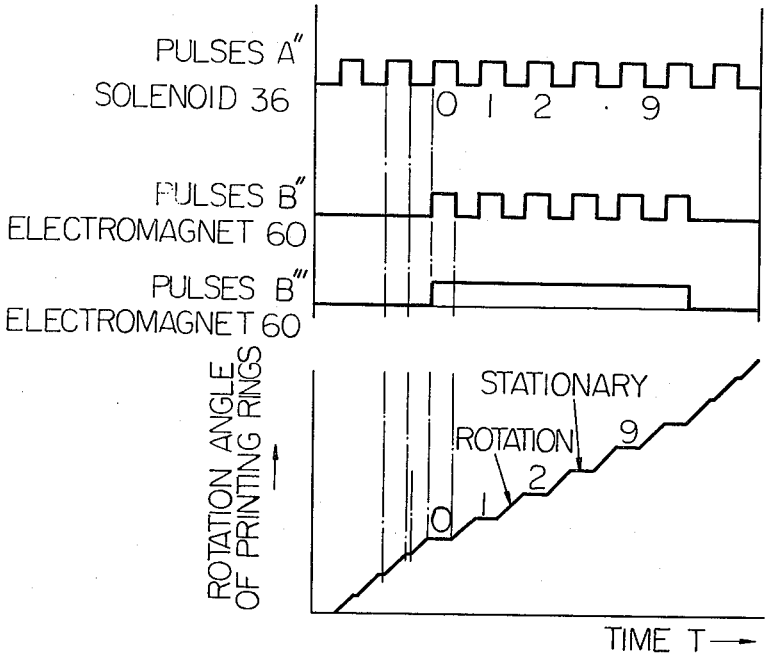
FIG. 9 is a diagram similar to FIG. 3 but showing the one for the modified embodiment of FIG. 8.

FIG. 9 shows the time chart illustrating the manner in which the embodiment of FIG. 8 operates.

Figure 10:
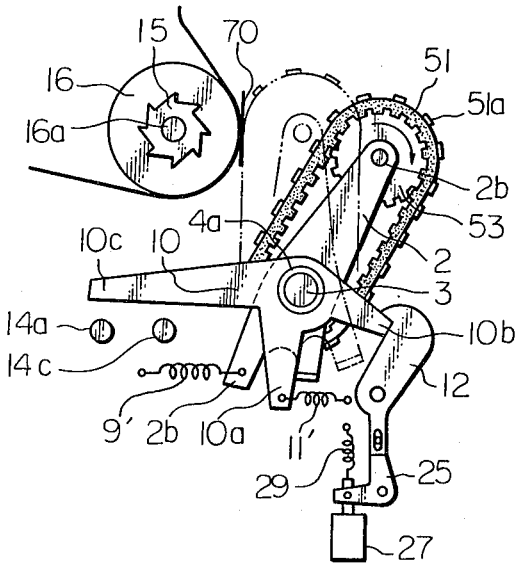
FIG. 10 is a fragmentary side view showing a variation of the present invention wherein a plurality of printing character supporting belts are used for the printing operation in place of the printing rings.

FIG. 10 shows a further variation of the printer to which the present invention is applied.

In this embodiment, the printing rings 1 of FIG. 1 are replaced by printing character supporting belts 51 each stretched around a sprocket (not shown) provided in place of the gear 4 of FIG. 1 and a sprocket 53 provided in place of the printing ring 1 of FIG. 1 so that the belt 51 is fed around the sprockets so as to position successive characters 51*a* at the printing position. The operation of the embodiment of FIG. 10 is similar to that of FIG. 1.

Figure 11:
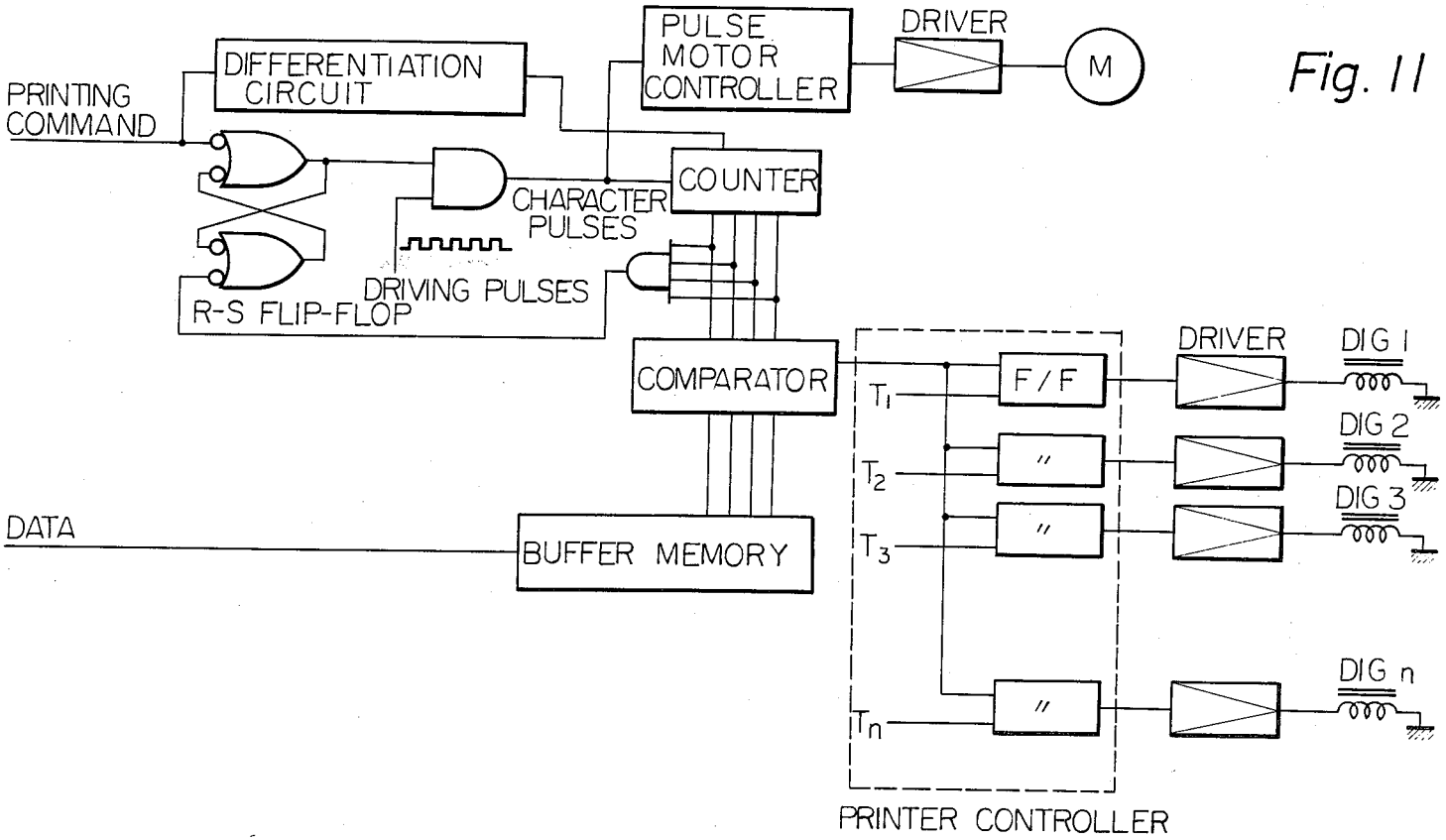
FIG. 11 is a block diagram showing an example of the control circuit of the printer of the present invention.

FIG. 11 shows as an example the control circuit for operating the printer shown in FIG. 4.

Upon input of a printing command, the R-S flip-flop is opened so as to issue the driving pulses (FIG. 5) for driving the pulse motor 8 (FIG. 1) or the plunger solenoid 20 (FIG. 2) through the pulse motor controller intermittently.

On the other hand, the driving pulses serve as the character pulses as described previously and they are applied to the circuit consisting of the counter and the comparator.

The result obtained by the counter is compared in the comparator with the parallel signal converted from the printing data input by the buffer memory.

The output of the comparator is actuated when the parallel signal from the buffer memory is coincident with the result of the counter, so that the driver is actuated through the printer controller so as to energize the magnet 27 (FIG. 1A) thereby selecting the character 1*a* in each printing ring 1.

In order to actuate the respective driver for each printing ring 1, timing pulses $T_1$–$T_n$ are applied to sequentially operate the respective driver for each printing ring 1.

When the printing operation by all the printing rings 1 is completed, the signal thereof is fed back to the flip-flop from the counter through the AND circuit so as to reset the same thereby rendering the driving pulse motor 8 to be made inoperative until the next printing command is applied.

Figure 12:
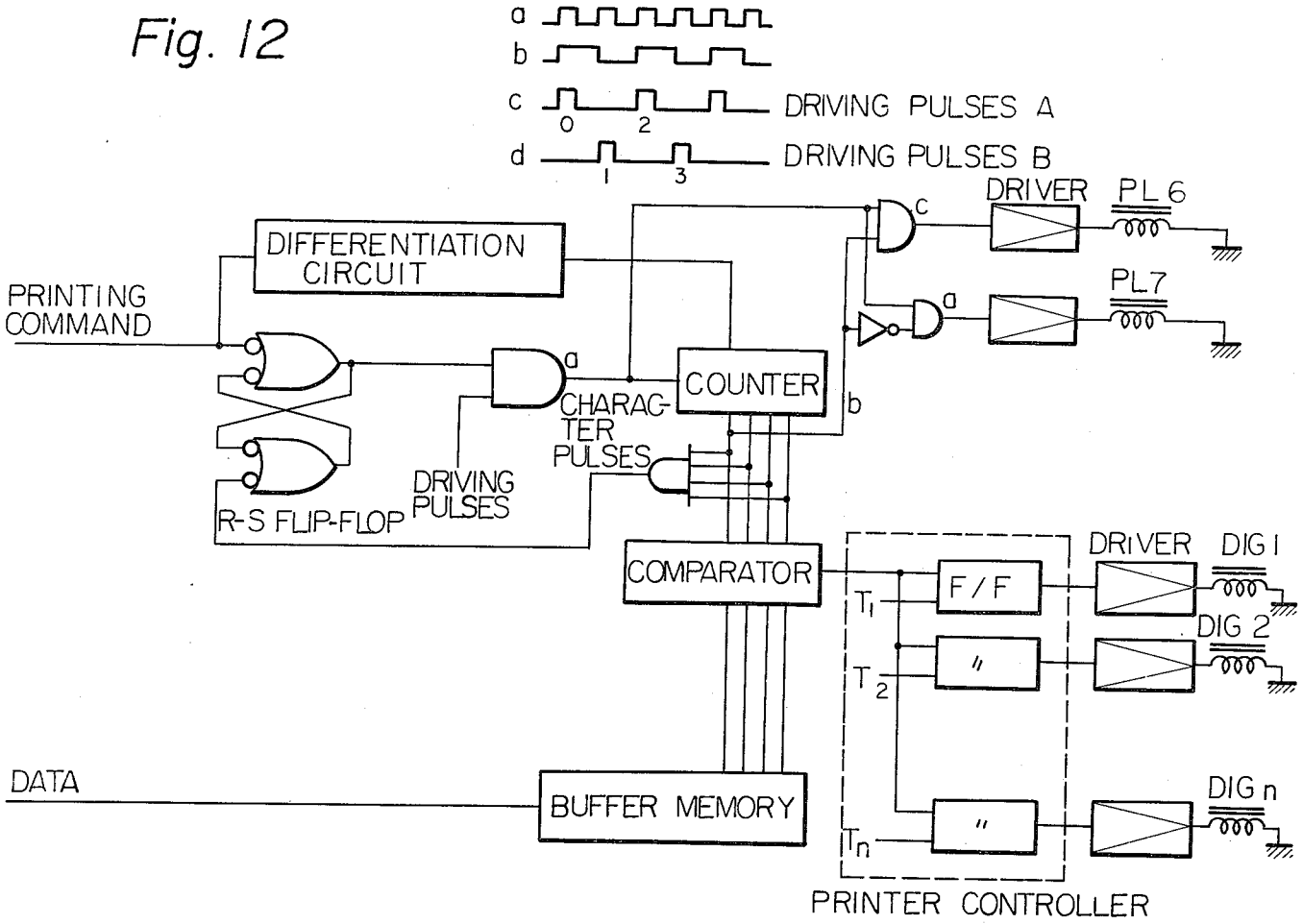
FIG. 12 is a block diagram showing an example of the electric circuit for issuing the driving pulses A, B shown in FIG. 7.

FIG. 12 shows the control circuit for issuing the driving pulses A, B of FIG. 7.

This circuit is substantially similar to that shown in FIG. 11 except that the pulse motor controller of FIG. 11 is replaced by a pair of AND gates, the outputs of which two AND gates are connected to the PL 6 (solenoid 36) and PL 7 (solenoid 37) while one of the AND gates includes an invertor in the input thereof, so that the driving pulses A, B are generated alternatingly as shown in FIG. 7.

In order to change the frequency each of the driving pulses A, B, clock pulses are applied to the circuit in timed relationship to the rotation of the printing rings.

Figure 13:
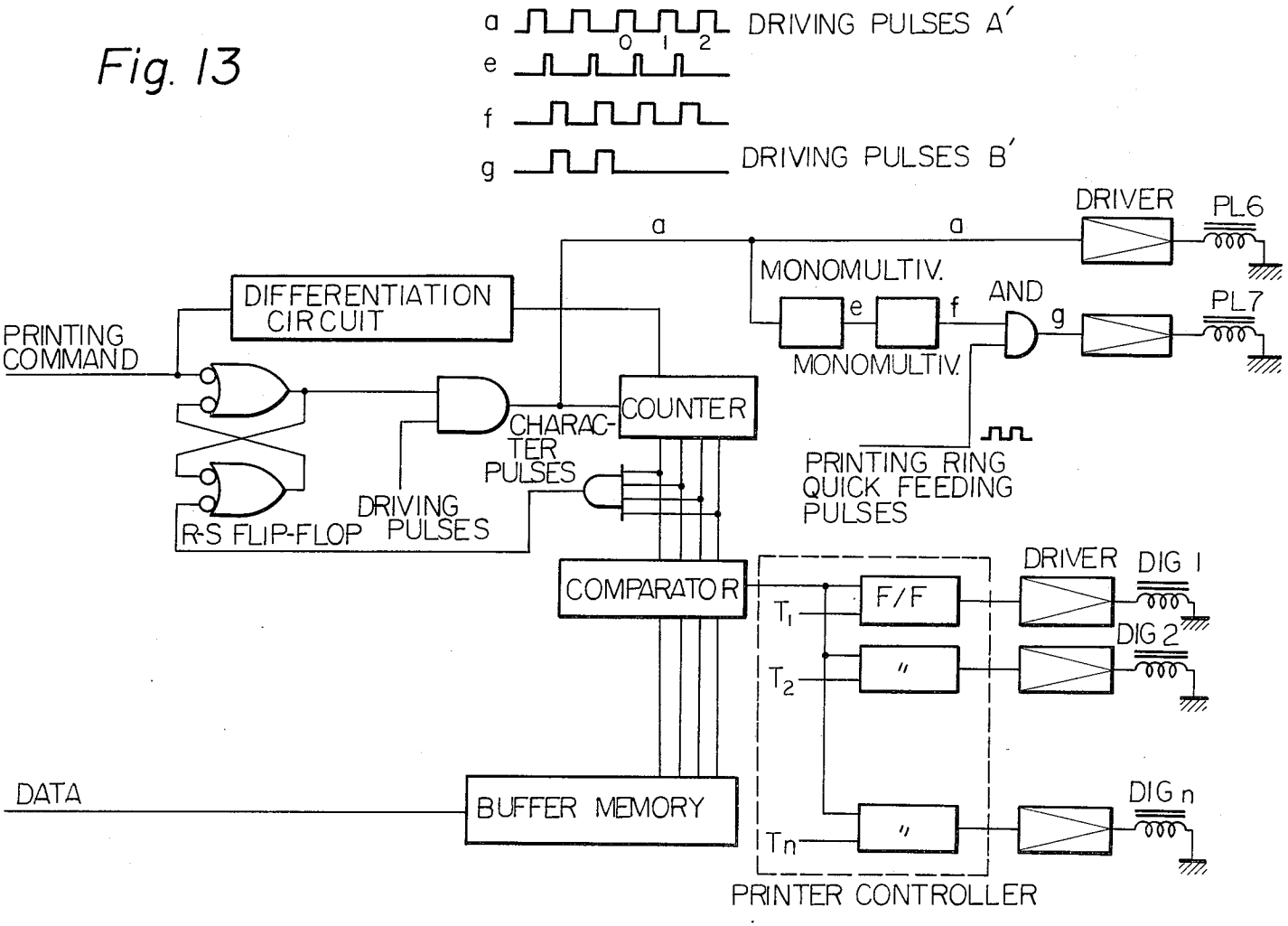
FIG. 13 is a block diagram showing an example of the electric circuit for issuing the driving pulses A', B' shown in FIG. 7.

FIG. 13 shows the circuit for generating driving pulses A′, B′ in FIG. 7.

The construction of this circuit is substantially similar to FIG. 12. In order to control the driving pulses B′, an AND gate is provided to one input of which printing ring quick feeding pulses are applied where quick feeding of the printing rings 1 is required.

Since the control circuits per se are not the subject matter of the present invention, detailed description thereof is omitted.

I claim:

1. In a device for driving printing character supporting means in a printer having control circuit means for issuing a printing selection command to initiate a printing operation in said printer, a plurality of printing character supporting means rotatable about a first axis, each said plurality of printing character supporting means including printing characters thereon, swingable levers each rotatably supporting the respective printing character supporting means and swingable about a second axis so as to move said printing character supporting means towards and against a platen and away therefrom, driving means for rotating each printing character supporting means about said first axis thereby permitting the respective printing character supporting means to be selectively moved towards and against said platen while the respective printing character supporting means is rotated so as to position a selected one of the printing characters at a printing position in cooperation with said platen upon receipt of said printing selection command from said control circuit of the printer so as to print said selected one of the printing characters to be printed onto a paper held between said printing character supporting means and said platen, the improvement wherein each of said printing character supporting means being independent of each other, each said printing character supporting means being rotatable by said driving means independently of said other printing character supporting means, said driving means being controlled by driving pulses for rotation of said printing character supporting means intermittently to select said selected one of said printing characters and upon receipt of the printing character selection command to stop the rotation of said printing character supporting means and commence the swinging movement of said swingable levers, means responsive to a printing signal for swinging said swingable lever supporting said respective printing character supporting means about said second axis for movement thereof towards and against said platen after said driving means has positioned a selected printing character supporting means at a printing position, and said driving means comprises a single plunger solenoid cooperating with a ratchet wheel guided by a driving shaft for driving said printing character supporting means, and another solenoid and a bell-crank lever associated therewith and said ratchet wheel and cooperating with said single plunger solenoid, said other solenoid being operative with said single plunger solenoid to control the speed of rotation of said printing character supporting means.

2. Device according to claim 1, wherein said printing character supporting means are printing rings each supporting on the periphery thereof a plurality of printing characters.

3. Device according to claim 1, wherein said printing character supporting means are printing character supporting belts each supporting on the outer surface thereof a plurality of printing characters.

4. Device according to claim 1, wherein said circuit includes means responsive to said driving pulses to produce character pulses for said printing character selection command.

5. Device according to claim 1, wherein said driving source comprises a pulse motor.

6. Device according to claim 1, wherein said single plunger solenoid includes an arm having an elongated hole, said driving shaft slidably fitting within said elongated hole, a pair of claw levers engaging with said ratchet wheel, and said bell crank lever includes means cooperating with one said claw levers for disengagement thereof from said ratchet wheel when said other solenoid is energized.

7. In a device for driving printing character supporting means in a printer having control circuit means for issuing a printing selection command to initiate a printing operation in said printer, a plurality of printing character supporting means rotatable about a first axis, each said plurality of printing character supporting means including printing characters thereon, swingable levers each rotatably supporting the respective printing character supporting means and swingable about a second axis so as to move said printing character supporting means towards and against a platen and away therefrom, driving means for rotating each printing character supporting means about said first axis thereby permitting the respective printing character supporting means to be selectively moved towards and against said platen while the respective printing character supporting means is rotated so as to position a selected one of the printing characters at a printing position in cooperation with said platen upon receipt of said printing selection command from said control circuit of the printer so as to print said selected one of the printing characters to be printed onto a paper held between said printing character supporting means and said platen, the improvement wherein each of said printing character supporting means being independent of each other, each said printing character supporting means being rotatable by said driving means independently of said other printing character supporting means, said printing means being controlled by driving pulses for rotation of said printing character supporting means intermittently to select said selected one of said printing characters and upon receipt of the printing character selection command to stop the rotation of said printing character supporting means and commence the swinging movement of said swingable levers, means responsive to a printing signal for swinging said swingable lever supporting said respective printing character supporting means about said second axis for movement thereof towards and against said platen after said driving means has positioned a selected printing character supporting means at a printing position, said driving means comprising a pair of plunger-solenoids cooperating with a ratchet wheel secured to a driving shaft for driving said printing character supporting means, said pair of solenoids being driven intermittently and alternatingly by said driving pulses, and both said plunger-solenoids being alternately operated by the driving pulse during the operation of non-selection, while, during the operation of selection, only one of said plunger-solenoids is operated by said driving pulses.

8. Device according to claim 7, wherein said solenoids are arranged in axial symmetry with respect to said driving shaft to provide for the rotation of said drive shaft in response to said solenoids being driven intermittently and alternatingly so as to rotate each said printing device by one pitch between two adjacent characters.

9. In a device for driving printing character supporting means in a printer having control circuit means for issuing a printing selection command to initiate a printing operation in said printer, a plurality of printing character supporting means rotatable about a first axis, each said plurality of printing character supporting means including printing characters thereon, swingable levers each rotatably supporting the respective printing character supporting means and swingable about a second axis so as to move said printing character supporting means towards and against a platen and away therefrom, driving means for rotating each printing character supporting means about said first axis thereby permitting the respective printing character supporting means to be selectively moved towards and against said platen while the respective printing character supporting means is rotated so as to position a selected one of the printing characters at a printing position in cooperation with said platen upon receipt of said printing selection command from said control circuit of the printer so as to print said selected one of the printing characters to be printed onto a paper held between said printing character supporting means and said platen, the improvement wherein each of said printing character supporting means being independent of each other, each said printing character supporting means being rotatable by said driving means independently of said other printing character supporting means and the coupling relationship between said driving means and said printing character supporting means being maintained at all times thereby insuring the rotation of said printing character supporting means as said driving means rotates, said driving means being controlled by driving pulses for rotation of said printing character supporting means intermittently to select said selected one of said printing characters and upon receipt of the printing character selection command to stop the rotation of said printing character supporting means and commence the swinging movement of said swingable levers, and means responsive to a printing signal for swinging said swingable lever supporting said respective printing character supporting means about said second axis for movement thereof towards and against said platen after said driving means has positioned a slected printing character supporting means at a printing position, said driving means being stationarily held when said printing character supporting means is operated for the selective printing.

10. Device according to claim 9, wherein said driving means is effective to operate the said printing supporting means randomly in time sequence so that the printing operation in one line is completed upon operation of all of said printing character supporting means.

11. Device according to claim 9, including means to stop said driving means and to move said printing character supporting means into engagement with said platen to effect the printing operation.

* * * * *